United States Patent [19]

Koike

[11] Patent Number: 4,499,612

[45] Date of Patent: Feb. 19, 1985

[54] POCKET FOR GARMENTS

[76] Inventor: Shunji Koike, 14-90 3-Ban 5 Chome, Ohmiya, Asahiku Osaka, Japan

[21] Appl. No.: 482,807

[22] Filed: Apr. 7, 1983

[51] Int. Cl.[3] ..... A41D 27/20

[52] U.S. Cl. ..... 2/250; 2/253

[58] Field of Search ..... 2/250, 253, 247, 248, 2/251, 254

[56] References Cited

U.S. PATENT DOCUMENTS

| | | | |
|---|---|---|---|
| 2,165,843 | 7/1939 | Feit | 2/253 |
| 2,383,217 | 8/1945 | Schaffer | 2/253 |
| 2,407,888 | 9/1946 | Lesser | 2/253 |

*Primary Examiner*—Doris L. Troutman

*Attorney, Agent, or Firm*—Stoll, Wilkie, Previto & Hoffman

[57] ABSTRACT

A garment pocket construction comprising a normally open pocket into which objects are placed, an adjacent normally closed pocket, and a pouch connected to both pockets, the normally open pocket communicating with the pouch through a small opening through which small objects placed in the normally open pocket drop into the pouch, the normally closed pocket being open to the pouch for retrieval of the small objects dropped into the pouch. The normally closed pocket is provided with a closure which is opened to gain access to the pouch through said normally closed pocket.

6 Claims, 6 Drawing Figures

POCKET FOR GARMENTS

DESCRIPTION

1. Technical Field

This invention relates to articles of clothing, particularly outer clothing such as pants and jackets.

2. Background Art

Means and devices for foiling pickpockets are known to the art. They include pocket closures of various kinds, concealed pockets, secret compartments and the like.

3. Disclosure of Invention

The basic feature of the invention resides in the provision of two adjacent pockets which communicate with a single pouch. The outward appearance is of a single pocket of conventional construction and for conventional use. What is not outwardly apparent is that small objects such as coins, placed in said pocket do not remain there but drop through a small opening into the pouch. Access to the pouch to remove these small objects is only through the second pocket which is not outwardly visible. And to gain access to said second pocket it is necessary to open a closure provided thereon. The pouch does not receive objects from the first pocket alone; larger objects may be inserted for safekeeping in the pouch through the second pocket.

DESCRIPTION OF PREFERRED EMBODIMENT OF INVENTION

This invention comprises an improvement in garment pockets.

Conventionally, pockets formed in pants, jackets, and other garments are open at the upper end. As a result, when the garment is hung upside down, for example on a hanger, items in the pockets, especially small heavy ones such as coins often fall out and scatter on the floor. A slide fastener could be attached to the open end of the pocket to prevent such an event; however this has the disadvantage of having to open the slide fastener in order to gain access to the pocket.

For men's clothing in particular, a generous number of pockets is frequently provided, but there is also a demand for pockets in women's garments to reduce the need for separate pocketbooks. For men who do not carry pocketbooks, pockets are needed to carry essential items such as a handkerchief, tissues and coins. Thus the need for a practical, convenient and functional pocket is increasing to meet current lifestyle requirements.

This invention has as its purpose the the improvement of conventional garment pockets in terms of style, construction and usage, providing convenience and security in use.

Figure 2:
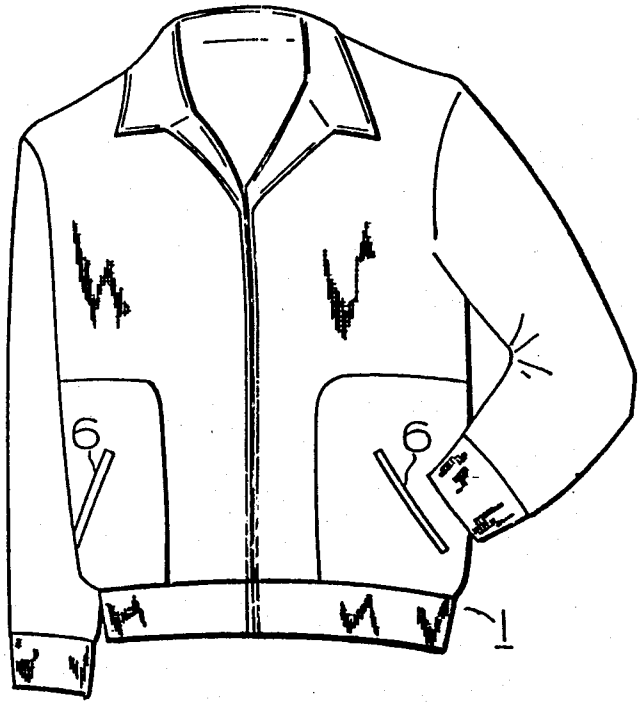
FIG. 2 is a front view of a jacket to which the present invention is applied.
Figure 1:
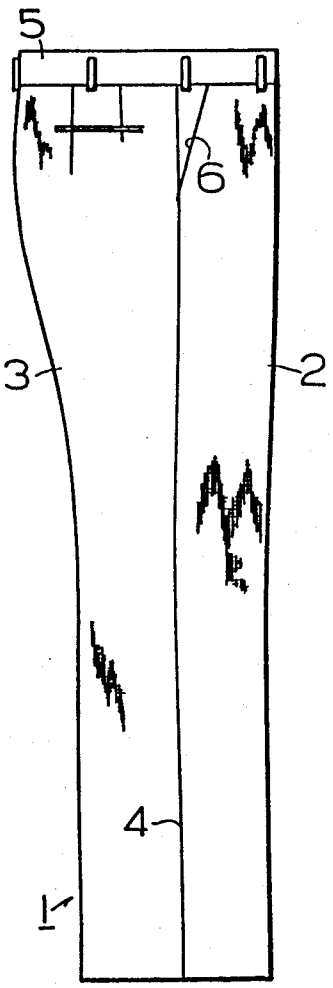
FIG. 1 is a side view of a pair of pants to which the present invention is applied.
Figure 4:
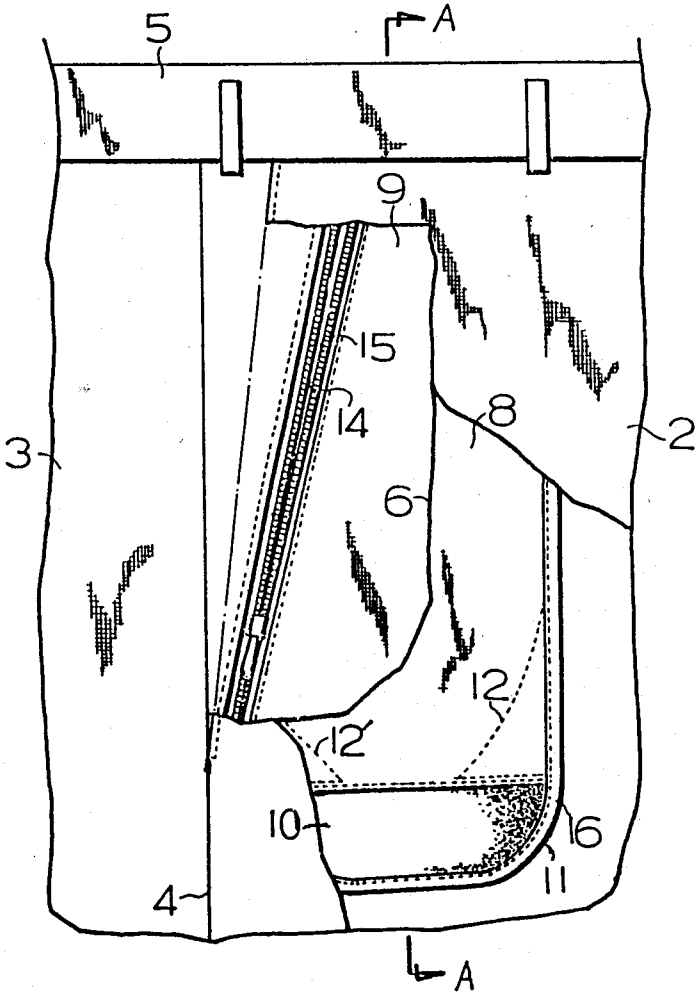
FIG. 4 is a view similar to that of FIG. 3 but partially broken away to show other details of the pocket construction.
Figure 3:
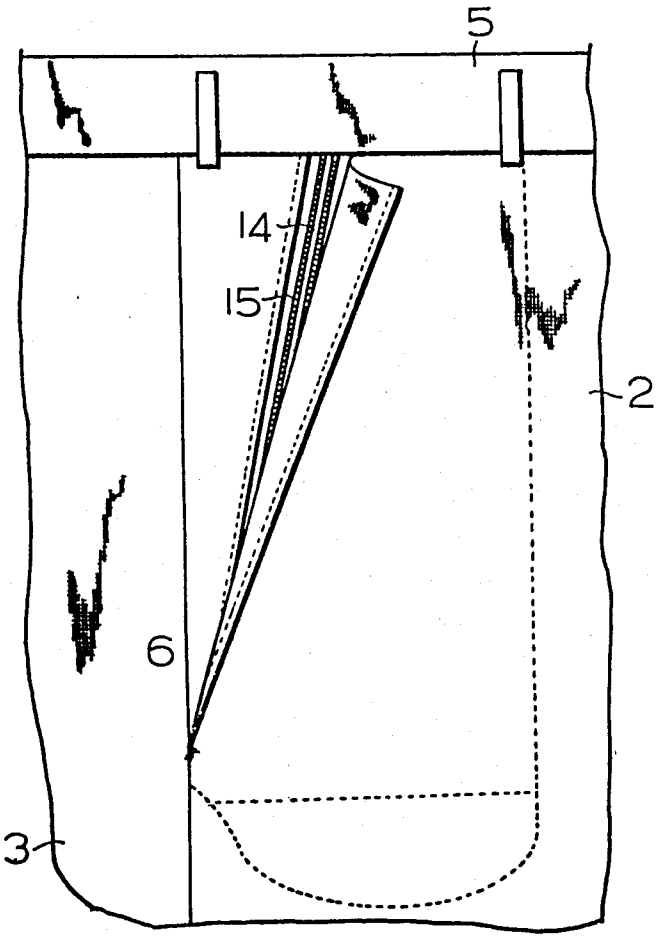
FIG. 3 is an enlarged, fragmentary view showing details of the pocket construction of the present invention as applied to the pants shown in FIG. 1.
Figure 5:
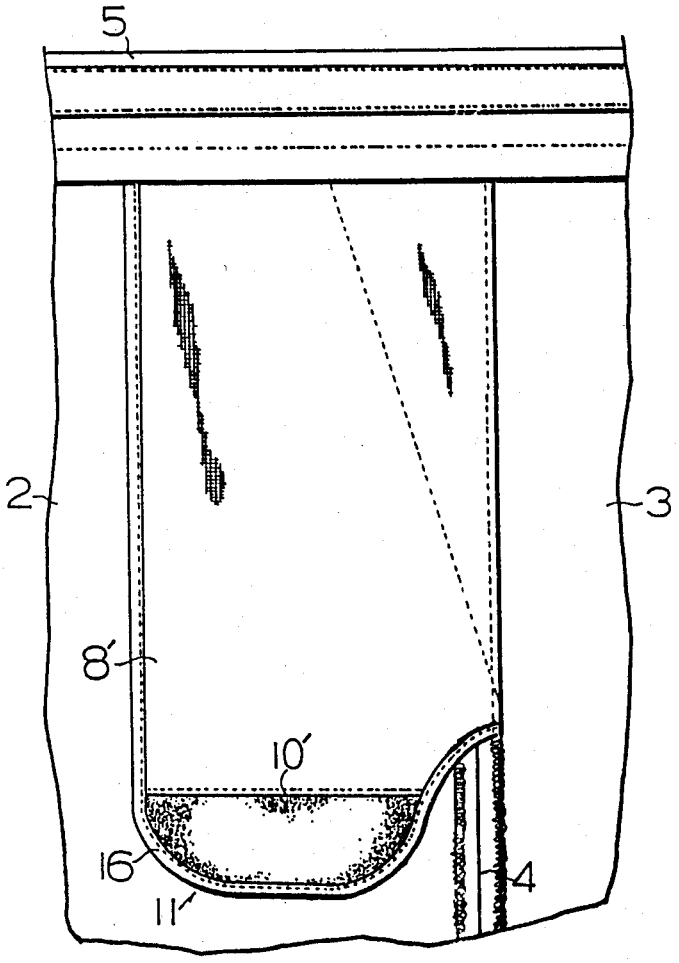
FIG. 5 is an enlarged, fragmentary view of the inside of the pants shown in FIG. 1, showing details of the pocket construction herein claimed.
Figure 6:
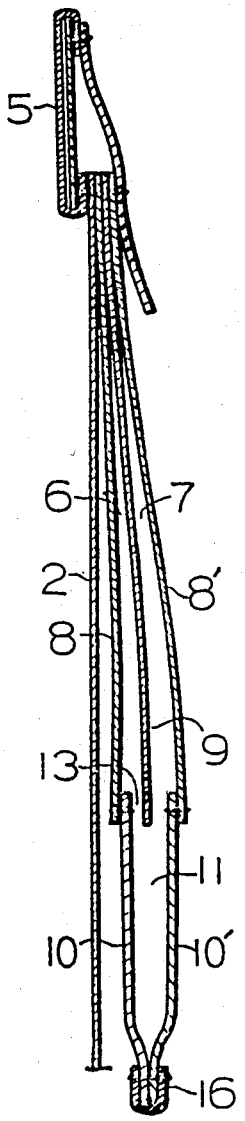
FIG. 6 is a vertical section in the line A—A of FIG. 4.

With respect to the drawings, an illustrative garment comprises the combination of a pair of pants 1*a* and a jacket 1*b*, but it will be understood that the invention is applicable to either component separately or to any other garment in which pockets may be constructed. For illustrative purposes, the pocket construction of the pants alone is shown in the drawings, but the same construction is equally applicable to the jacket. The following parts of the pants may be entirely conventional: the front 2, back 3, side seam 4 and waist band 5.

A normally open pocket 6 and a normally closed pocket 7 are incorporated into the garment at the upper part of side seam 4. Normally open pocket 6 is a cloth pocket with an outer side 8 and an inner side 9 which are attached at their upper ends to the waistband of the garment. Normally closed pocket 7 is also a cloth pocket with an inner side 8$^1$ and an outer side which is the same piece of material which comprises the inner side 9 of the normally open pocket. In effect, said inner side 9 is a partition between the two pockets while serving as the inner side of the normally open pocket and the outer side of the normally closed pocket.

At the bottom of both pockets is a synthetic leather pouch 11 having an outer wall 10 and an inner wall 10$^1$. The outer wall is sewn to outer side 8 of the normally open pocket 6 and the inner wall is sewn to the inner side 8$^1$ of the normally closed pocket 7. The pouch is closed at the bottom and ends as by means of a binding tape 16 sewn thereto.

Normally closed pocket 7 is open at the bottom to provide access to the pouch. In normally open pocket 6, outer side 8 and inner side 9 are sewn to each other along their side edges by means of seams 12, 12$^1$ which converge toward each other, but do not meet, at their lower ends, to form a funnel-shaped configuration with a relatively small opening 13 at the bottom. It is through this opening that communication is provided between said normally open pocket 6 and pouch 11.

The two pockets have side openings, preferably cut diagonally, normally open pocket having side opening 14 and normally closed pocket having side opening 14$^1$. Access to the pockets is provided through said diagonal side openings. But normally closed pocket 7 has a slide fastener 15 which provides a closure for its diagonal side opening 14$^1$ and this slide fastener is normally maintained in closed condition.

In the use of a garment equipped with the above-described normally open and normally closed pockets, articles of various kinds, e.g., a handkerchief and a plurality of coins, are inserted into normally open pocket 6. The handkerchief remains in said pocket because it is relatively light in weight and relatively large in size, that is, in relation to the size of opening 13. The coins, on the other hand, are relatively small and relatively heavy, and they would drop through opening 13 into pouch 11. It is not feasible to reach these coins through opening 13. To reach them, it is necessary to open slide fastener 15 and to reach in through normally closed pocket 7 into pouch 11.

It will be understood that the foregoing description merely illustrates the invention and that modifications may be incorporated therein within the scope of the appended claims. For example, the use of leather, synthetic or natural, for the pouch is merely illustrative of the many conventional pouch materials that may be used. A pouch made of synthetic or natural leather will have the advantages of a leather coin purse, for example, reducing the jangling of coins when jogging. The use of a slide fastener as described is also illustrative of various conventional closures and closure methods, e.g., overlapping the sides of the normally closed pocket at the opening. The particular funnel-shaped approach to the small opening in the normally open pocket, as described, and said opening itself, are both purely illustrative. The objective is to provide limited communication between the normally open pocket and the pouch to screen the smaller objects, such as coins, from the larger objects, such as handkerchiefs, and to pass the smaller objects into the pouch while retaining the larger objects in the pocket. The opening should also be of such small size as to render it difficult to reach in through said opening into the pouch. To illustrate, the opening should be no larger than the largest coin of general use, for example, a quarter in the United States, other coins in other countries, for example, 500 yen coins in Japan. It should also be understood that the pouch need not be a separate unit; it may be an integral extension of the normally closed pocket.

What is claimed is:

1. A pocket construction for garments, comprising:

a. a first pocket and a second pocket, b. said first pocket being secured to said second pocket, and both pockets being secured to a garment, c. the bottom of the second pocket extending a spaced distance below the bottom of the first pocket and forming a pouch portion for both pockets, d. a relatively small opening formed in the bottom of the first pocket and providing a passage from the first pocket into said pouch portion, e. said opening being of a size which would allow small articles such as coins to pass therethough, but would prevent larger articles from passing therethrough, f. whereby small articles deposited in the first pocket pass through said opening and are collected in said pouch portion from which they are retrievable through the second pocket, and g. whereby larger articles deposited in the first pocket are prevented from passing through said opening and are collected in said first pocket from which they are retrievable.

2. A pocket construction in accordance with claim 7, wherein:

a. the first pocket is formed of first and second side walls, and b. the second pocket is formed of two side walls, one of them being said second side wall which it shares with the first pocket, the other being an additional side wall, c. said first and additional side walls extending below said second side wall and forming said pouch portion below the first pocket.

3. A pocket construction in accordance with claim 8, wherein:

the pouch portion is integral with the first and additional side walls.

4. A pocket construction in accordance with claim 8, wherein:

a. the pouch portion is made of coin pouch material, b. said pouch portion being secured to said first and additional side walls.

5. A pocket construction in accordance with claim 7, wherein:

a. the first pocket has a tapered configuration at its lower end converging toward the opening therein, b. whereby a funnel-shaped approach to said opening is formed to guide small articles into said opening.

6. A pocket construction in accordance with claim 7, wherein:

a. a closure is provided at the upper end of the second pocket, b. whereby access through said second pocket to the small articles collected in the pouch portion is prevented.

* * * * *